United States Patent [19]

Egerer

[11] Patent Number: 4,625,366

[45] Date of Patent: Dec. 2, 1986

[54] OPENING CYLINDER FOR OPEN-END SPINNING MACHINES OR THE LIKE

[75] Inventor: Josef Egerer, Schwabach, Fed. Rep. of Germany

[73] Assignee: Staedtler & Uhl., Schwabach, Fed. Rep. of Germany

[21] Appl. No.: 787,996

[22] Filed: Oct. 16, 1985

[30] Foreign Application Priority Data

Oct. 18, 1984 [DE] Fed. Rep. of Germany ..... 3438133

[51] Int. Cl.[4] ..... D01B 19/00

[52] U.S. Cl. ..... 19/97; 19/112

[58] Field of Search ..... 19/97, 112, 113, 114, 19/115 R, 233, 234, 126, 128, 112

[56] References Cited

U.S. PATENT DOCUMENTS

| | | | |
|---|---|---|---|
| 798,913 | 9/1905 | Meyers | 19/233 |
| 2,694,835 | 11/1954 | Sofio | 19/128 |
| 2,940,129 | 6/1960 | Stewart | 19/115 R |
| 3,646,639 | 3/1972 | Burckhardt et al. | 19/97 |

*Primary Examiner*—Louis K. Rimrodt

*Attorney, Agent, or Firm*—Browdy and Neimark

[57] ABSTRACT

The invention relates to an opening cylinder for open-end spinning machines or the like comprising a cylindrical basic body (1) with helically extending grooves (2) for the accommodation for fittings. To achieve high combing quality with easy replaceability of the fittings and low cost weight-saving design of the basic body, it is provided according to the invention that the grooves (2) for the accommodation of the root (9) of a needle-bar (8) exhibit an undercut and run at an acute angle ($\alpha$) to the longitudinal axis (3) of the cylindrical basic body (1).

4 Claims, 4 Drawing Figures

OPENING CYLINDER FOR OPEN-END SPINNING MACHINES OR THE LIKE

BACKGROUND OF THE INVENTION

The invention relates to an opening cylinder for open-end spinning machines or the like and more particularly to opening cylinders including helically running grooves to accommodate fittings.

Such opening cylinders are used on a large scale in the textile industry. Their purpose includes breaking the fiber band fed to them into individual fibers. Accordingly, they are of essential importance for the end product to be produced. In this connection it is important that the fittings of such opening cylinders operate as continuously and as evenly as possible in the fiber flow.

Basically individual needles, needle bars or saw-tooth wires are known as fittings for such cylinders. The saw-tooth wires can be cheaply produced but will unravel. Thus, they do not guarantee optimum combing quality. In contrast, needle fittings are more desirable, but as a rule require higher expenditures for a first outfitting, or for replacement which is generally required at regular intervals.

To achieve a distribution as even as possible of the tips engaging the fiber band over the processing width, it is known, as described in DE-GM No. 73 45 782, to provide roller shells with a helically running groove for accommodating a saw-tooth wire. The saw-tooth wire is stretched in the groove, and if necessary, is additionally fastened by glueing. The grooves of such prior known rollers shells extend there around, so that the inclination of the helical lines in the projection form an angle somewhat less than 90° with the longitudinal axis of the roller shell. Such known roller shells with corresponding outfitting exhibit the fundamental disadvantages inherent in the system of saw-tooth wire outfitting, and cannot be simply replaced.

OBJECTS OF THE INVENTION

It is therefore an object of the invention to provide an opening cylinder that permits the use of light, and thus imbalance-insensitive, roller shells with continuous, even engagement of the fiber band, whereby re-outfittings in the user's enterprise can be accomplished quickly and without any problems.

This object is achieved by providing opening cylinders with grooves which are undercut and extend at an acute angle to the longitudinal axis of the cylinder body. The provisions of a helical recess with undercuts makes it possible to use needlebars with a degree of intrinsic elasticity of the root. The needlebars are held parallel to the longitudinal axis of the groove by the helical twisting without any additional holding devices. Moreover, in the radial direction, a corresponding projection in accordance with the undercut at the root of the needlebars can provide support. Thus these needlebars can be used without having to heat up to dissolve glue or solder connections, which can necessitate having to rebalance the rollers so treated and which requires corresponding technical resources. Moreover roller shells with a helically running groove, which according to the invention extend at an acute angle to the longitudinal axis of the body, can be produced cheaply and with the required precision from light aluminum parts by the use of a helical milling device. Finally, an optimum distribution of needles over the guide width is achieved by the arrangement of the needlebars according to the invention.

Another object of the invention is to provide an especially advantageous dimensioning for the angle between the grooves and the longitudinal axis.

Still another object is to provide for forming the undercut as a dovetailed profile. This makes possible an especially reliable seating of the needlebars in the grooves.

Yet another object is to provide a ratio for dimensioning of the groove inclination and cylinder longitudinal axis by which a very favorable needle distribution is achieved.

Still another object is to provide a needlebar which is suitable especially for an opening cylinder according to the invention.

BRIEF DESCRIPTION OF THE DRAWINGS

Further features, advantages and details of the invention will be realized from the following description of a preferred embodiment with the help of the drawings, in which.

DETAILED DESCRIPTION OF THE INVENTION

Figure 1:
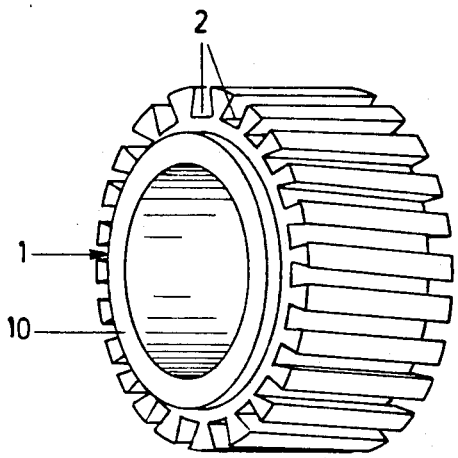
FIG. 1 shows a diagrammatic, perspective view of an opening cylinder according to the invention without fittings.
Figure 2:
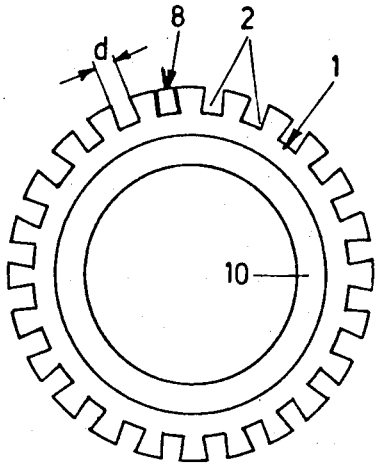
FIG. 2 shows a front view corresponding to FIG. 1.

An opening cylinder according to the invention comprises basic body 1. Grooves 2, running parallel to one another, are formed in the basic body 1 around the circumference by means of a helical milling device. In FIG. 2, it can be seen that these grooves 2 exhibit a dovetailed profile.

Figure 3:
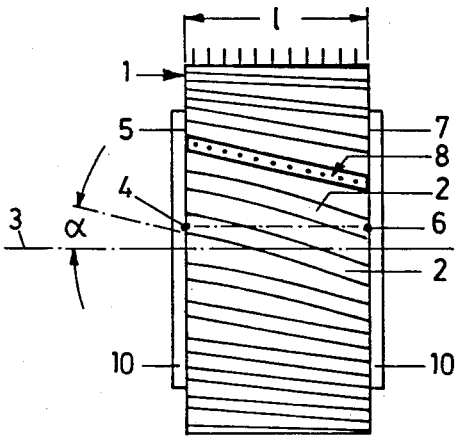
FIG. 3 illustrates a side view of the opening cylinder.
Figure 4:
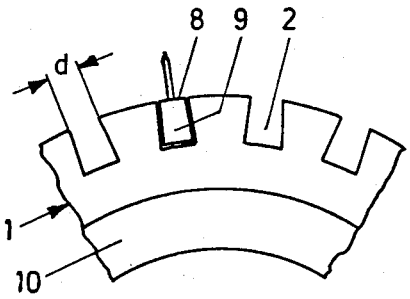
FIG. 4 shows an enlarged partial view of the front of the opening cylinder with a needle fitting.

The grooves extend helically relative to the cylindrical basic body 1 (see FIG. 3). Each groove 2 exhibitis an inclination of between 5° and 30° in relation to longitudinal axis 3 of basic body 1. In the embodiment of FIG. 3, an inclination of $=13°$ was chosen.

Inclinatin, relation to length L of the basic body or width d of grooves 2, is chosen so that, in one direction parallel to longitudinal axis 3, center 4 of the end of a groove 2 at one front 5 of basic body 1 is level with center 6 of an adjacent groove 2 on the other front 7 respectively of basic body 1.

In FIG. 2, e.g., the outfitting by means of a needlebar 8 is illustrated with the help of a groove. Such a needle bar consists of a multiplicity of needles arranged in a row which are interconnected by a root 9, which is extruded from plastic. For this purpose a plastic is chosen which on the one hand exhibits a dimensional stable, wear-resistant surface and on the other hand possesses such an intrinsic elasticity that, when inserted into a groove 2, it can follow its helical course without any problem. As a result, a solid, defined seating of needlebar 8 is achieved without any additional holding device. In addition, holding disks can be placed on hub attachments 10 to anchor the needlebars.

The design according to the invention makes it possible with excellent fiber control qualities for the user himself at a time convenient to him to undertake a new outfitting so that the costs for that purpose are small.

What is claimed is:

1. Opening cylider for open-end spinning machines or the like, comprising:

a cylindrical basic body;

undercut grooves disposed in the outer surface of said cylindrical body, said grooves running helically at an acute angle ($\alpha$) to the longitudinal axis of said cylindrical body; and needlebars having plastic roots with an intrinsic elasticity, said needlebars being inserted and retained in said grooves;

whereby the needlebars are held parallel to the longitudinal axis of said cylindrical body due to the helical twisting of their roots.

2. Opening cylinder according to claim 1, wherein the angle ($\alpha$) between the grooves and the longitudinal axis is between 5° and 30°.

3. Opening cylinder according to claim 1, wherein the grooves are dovetailed in profile.

4. Opening cylinder according to claim 1, wherein the inclination ($\alpha$) is dimensioned so that, projected to the longitudinal axis of the cylindrical basic body, the groove center at the end of a groove at one side is in alignment with the center at the end of the adjacent groove at the other front of the cylindrical basic body.

* * * * *